US007332137B2

(12) United States Patent
DeSousa et al.

(10) Patent No.: US 7,332,137 B2
(45) Date of Patent: Feb. 19, 2008

(54) END CONE ASSEMBLY, EXHAUST EMISSION CONTROL DEVICE AND METHOD OF MAKING THEREOF

(75) Inventors: Egas DeSousa, Grand Blanc, MI (US); John Boenhke, Grand Blanc, MI (US); David Lucky, Flushing, MI (US); Alan G. Turek, Mayville, MI (US)

(73) Assignee: Delphi Technologies, Inc., Troy, MI (US)

( * ) Notice: Subject to any disclaimer, the term of this patent is extended or adjusted under 35 U.S.C. 154(b) by 914 days.

(21) Appl. No.: 10/395,794

(22) Filed: Mar. 24, 2003

(65) Prior Publication Data

US 2004/0191132 A1 Sep. 30, 2004

(51) Int. Cl.
*B01D 50/00* (2006.01)

(52) U.S. Cl. ..... 422/179; 422/180

(58) Field of Classification Search ..... 422/179, 422/180; 29/860

See application file for complete search history.

(56) References Cited

U.S. PATENT DOCUMENTS 4,335,077 A * 6/1982 Santiago et al. ..... 422/179
5,782,089 A * 7/1998 Machida et al. ..... 60/299
6,010,668 A 1/2000 Lawrence et al.
6,159,430 A 12/2000 Foster et al.
6,338,827 B1 1/2002 Nelson
6,354,903 B1 3/2002 Nelson
6,361,821 B1 3/2002 Anderson et al.
6,391,822 B1 5/2002 Dou et al.
6,438,839 B1 8/2002 Hardesty et al.
6,455,463 B1 9/2002 Labarge et al.
6,464,945 B1 10/2002 Hemingway
6,464,947 B2 10/2002 Balland
6,497,847 B2 12/2002 Foster et al.
6,532,659 B1 3/2003 DeSousa et al.
6,591,497 B2 7/2003 Foster et al.
6,591,498 B2 7/2003 Irie et al. ..... 29/890

(Continued)

FOREIGN PATENT DOCUMENTS

GB 2370007 A 6/2002

(Continued)

*Primary Examiner*—Glenn A. Caldarola
*Assistant Examiner*—Tom Duong
(74) *Attorney, Agent, or Firm*—Paul L. Marshall

(57) ABSTRACT

An end cone assembly for an exhaust emission control device includes an inner cone spacedly disposed within an outer cone. The outer cone comprises a small outer cone end a large outer cone end and an outer wall that diverges from the small outer cone end to the large outer cone end. The inner cone comprises a small inner cone end and a large inner cone end with an inner wall having a first diameter proximal the first inner cone end, wherein the inner wall diverges to a second diameter, wherein the second diameter is disposed proximal a recessed portion having a third diameter at the second inner cone end, and wherein the first diameter is smaller than the third diameter and the third diameter is smaller than the second diameter. The outer wall is disposed in a spaced relation to at least a portion of the inner wall, and, with the exception of the recessed portion, the space between the inner and outer walls is free of insulating material. Disposed within the recessed portion of the inner cone is an insulating member.

12 Claims, 1 Drawing Sheet

U.S. PATENT DOCUMENTS

| | | | | |
|---|---|---|---|---|
| 6,605,259 | B1 | 8/2003 | Henry | |
| 6,623,704 | B1 | 9/2003 | Roth | |
| 6,624,113 | B2 | 9/2003 | Labarge et al. | |
| 6,643,928 | B2 | 11/2003 | Hardesty et al. | |
| 2002/0141907 | A1 | 10/2002 | Myers | 422/168 |
| 2002/0150518 | A1 | 10/2002 | Brush et al. | 422/180 |
| 2002/0172626 | A1 | 11/2002 | Lesher et al. | 422/179 |

FOREIGN PATENT DOCUMENTS

| | | | |
|---|---|---|---|
| WO | WO 9850688 | A1 * | 11/1998 |

* cited by examiner

END CONE ASSEMBLY, EXHAUST EMISSION CONTROL DEVICE AND METHOD OF MAKING THEREOF

BACKGROUND

Pollution or exhaust emission control devices are employed on motor vehicles to control atmospheric pollution. Types of devices currently in widespread use include sulfur traps, NOx adsorbers, catalytic converters and diesel particulate filters or traps. These types of devices contain a treatment element to control pollution. The treatment element in a catalytic converter, for example, can be a catalytic element, a substrate or a monolithic structure coated with a catalyst for the oxidation of pollutants and mounted in a housing. The treatment element can be mounted in a housing that often comprises a shell with end cone assemblies welded or otherwise attached to the ends of the housing for attachment to exhaust pipes or other exhaust components. The shell can be either circular or a suitable non-circular geometry.

End cone assemblies can be one piece or single end cone structures formed, for example, by spin forming techniques. Alternatively, end cone assemblies can be dual wall end cone assemblies comprising an inner cone and an outer cone. In such an assembly, the outer and inner end cones each typically have conical walls and comprise a large end for connecting to the housing or shell of the exhaust emission control device, and a small end for connecting with a pipe or other components of an automotive exhaust system. Between the inner cone and the outer cone is an insulating space. In previous dual wall end cone assemblies, such as that disclosed in U.S. Pat. No. 6,010,668 to Lawrence et al., the insulating space can contain an insulating material such as a fibrous insulating pad. While suitable for many applications, some disadvantages of this design include the high cost of the fibrous insulating material and difficulties in spin forming the end cones into non-circular cross sections.

There thus remains a need for improved end cone assemblies and exhaust emission control devices and methods of making exhaust emission control devices.

BRIEF SUMMARY

The above-described and other drawbacks are alleviated by an end cone assembly for an exhaust emission control device comprising an outer cone comprising a small outer cone end and a large outer cone end with an outer wall extending therebetween, wherein the outer wall diverges from proximal the small outer cone end toward the large outer cone end; an inner cone comprising a small inner cone end and a large inner cone end with an inner wall having a first diameter proximal the small inner cone end, wherein the inner wall diverges to a second diameter, wherein the second diameter is disposed proximal a recessed portion having a third diameter at the large inner cone end, and wherein the first diameter is smaller than the third diameter and the third diameter is smaller than the second diameter; and an insulating member disposed within at least a portion of the recessed portion of the inner cone; wherein the outer wall is disposed in a spaced relation to at least a portion of the inner wall and wherein, with the exception of the recessed portion, the space between the inner and outer walls is free of insulating material.

Further disclosed is an exhaust emission control device, comprising a shell; a treatment element disposed within the shell; a retention element disposed between the shell and the treatment element; and an end cone assembly disposed at a first end of the shell. The end cone assembly comprises an outer cone comprising a small outer cone end and an outer wall extending to and in contact with the shell, wherein the outer wall diverges from proximal the small outer cone end toward the shell, and wherein the outer cone and the shell are a single, continuous piece; an inner cone comprising a small inner cone end and a large inner cone end with an inner wall having a first diameter proximal the small inner cone end, wherein the inner wall diverges to a second diameter, wherein the second diameter is disposed proximal a recessed portion having a third diameter at the large inner cone end, and wherein the first diameter is smaller than the third diameter and the third diameter is smaller than the second diameter; and an insulating member disposed within the recessed portion of the inner cone; wherein the outer wall is disposed in a spaced relation to at least a portion of the inner wall and wherein, with the exception of the recessed portion, the space between the inner and outer walls is free of insulating material.

Also disclosed is a method of making an exhaust emission control device, comprising disposing within a shell a treatment element and a retention element wherein the retention element is between the treatment element and the shell; disposing onto a shell a dual end cone assembly comprising an outer cone comprising a small outer cone end and a large outer cone end with an outer wall extending therebetween, wherein the outer wall diverges from proximal the small outer cone end toward the large outer cone end; an inner cone comprising a small inner cone end and a large inner cone end with an inner wall having a first diameter proximal the small inner cone end, wherein the inner wall diverges to a second diameter, wherein the second diameter is disposed proximal a recessed portion having a third diameter at the large inner cone end, and wherein the first diameter is smaller than the third diameter and the third diameter is smaller than the second diameter; and an insulating member disposed within at least a portion of the recessed portion of the inner cone; wherein the outer wall is disposed in a spaced relation to at least a portion of the inner wall to form a dual wall end cone assembly and wherein, with the exception of the recessed portion, the space between the inner and outer walls is free of insulating material; and attaching the large outer cone end to a first end of the shell.

Another method of making an exhaust emission control device is disclosed comprising disposing within a shell a treatment element and a retention element, wherein the retention element is between the treatment element and the shell, and wherein the shell has a length greater than or equal to about a sum of a length of the treatment element and an inner end cone; disposing within the shell the inner cone comprising a small inner cone end and a large inner cone end with an inner wall having a first diameter proximal the first inner cone end, wherein the inner wall diverges to a second diameter, wherein the second diameter is disposed proximal a recessed portion having a third diameter at the second inner cone end, wherein the first diameter is smaller than the third diameter and the third diameter is smaller than the second diameter, and wherein an insulating member is disposed within at least a portion of the recessed portion of the inner cone; and spin forming a first end of the shell to form an outer cone comprising a small outer cone end and an outer wall extending to the shell, wherein the outer wall diverges from proximal the first end toward the shell, and wherein the outer wall is disposed in a spaced relation to at least a portion of the inner wall, and wherein, with the exception of the recessed portion, the space between the inner and outer walls is free of insulating material.

The above described and other features are exemplified by the following figures and detailed description.

BRIEF DESCRIPTION OF THE DRAWINGS

Referring now to the drawing wherein like elements are numbered alike in the FIGURE.

DETAILED DESCRIPTION OF THE PREFERRED EMBODIMENTS

Figure 1:
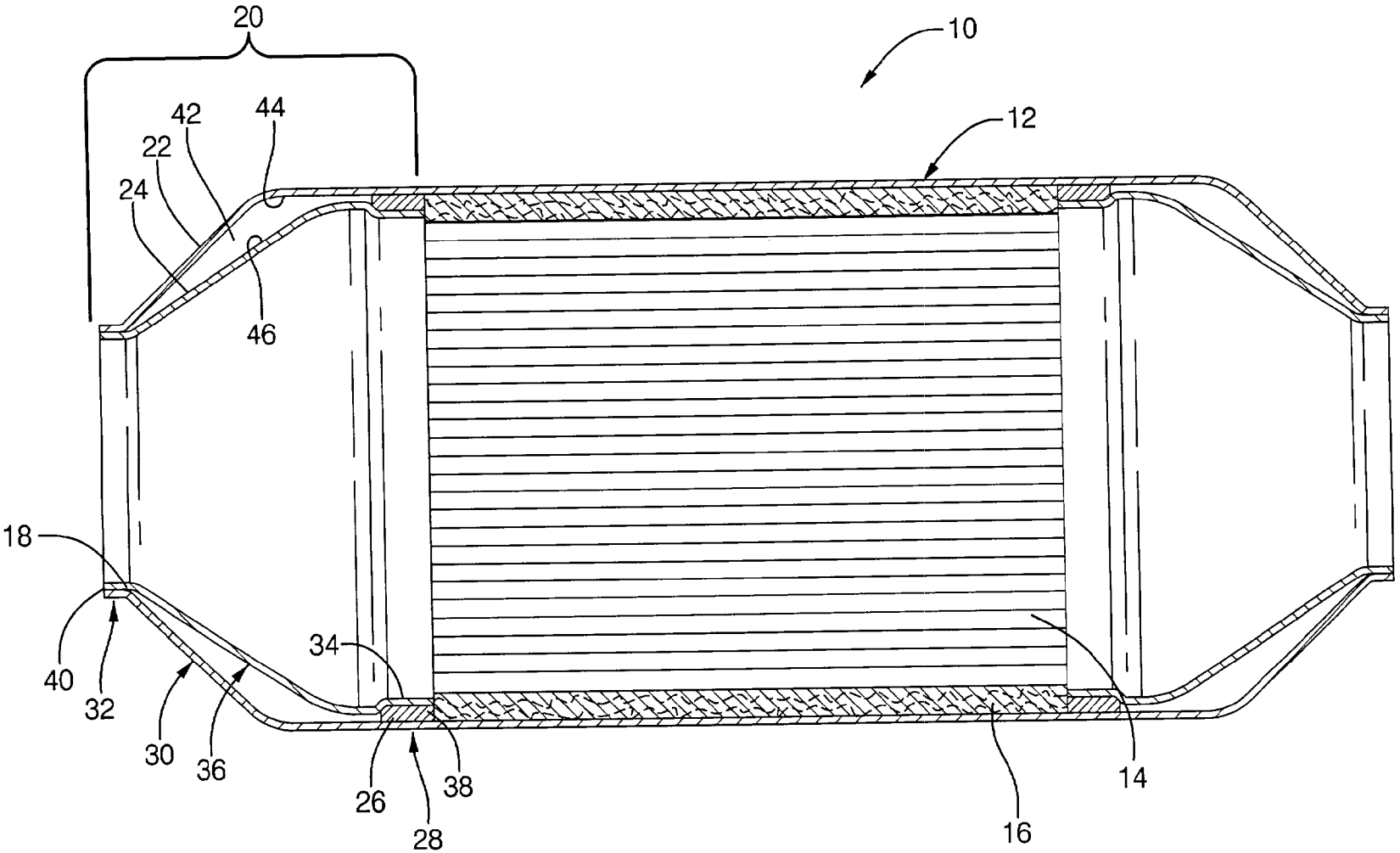
FIG. 1 shows an exemplary exhaust emission control device.

Exhaust emission control devices may comprise catalytic converters, evaporative emissions devices, scrubbing devices (e.g., those designed to remove hydrocarbon, sulfur, and the like), particulate filters/traps, adsorbers/absorbers, non-thermal plasma reactors, and the like, as well as combinations comprising at least one of the foregoing devices. Exhaust emission control devices can be placed in fluid communication with the exhaust system of an automobile or other emissions stream (e.g., a flue for a factory). An exhaust emission control device can include an outer metallic housing or shell, a treatment element, and a retention element. The treatment element converts, and/or eliminates one or more emissions from an exhaust gas. The retention element at least partially fills a space between the treatment element and the shell.

An exhaust emission control device can comprise an end cone structure at least at one end to connect the device to the exhaust pipes, pipe connectors or other components of an exhaust system. Disclosed herein is a new design for a dual wall end cone, an exhaust emission control device, and methods for manufacture of exhaust emission control devices. FIG. 1 illustrates an exhaust emission control device 10 comprising a shell 12 and dual wall end cone assembly 20. The dual wall end cone assembly 20 comprises an outer cone 22 and an inner cone 24. The assembly also comprises an insulating member 26.

The outer cone 22 comprises a large outer cone end 28 that can be sized to slide over one end of the shell 12. The large outer cone end 28 preferably has the same shape as the shell, i.e., cylindrical, oval, or other suitable shapes. Alternatively, the large outer cone end 28 can be integral with the shell 12, such as for example, when the outer cone 22 is formed by spin forming techniques. In this embodiment, the outer cone 22 diverges from at or near a small outer cone end 32 toward the large outer cone end 28.

The inner cone 24 comprises a large inner cone end 34 that can be disposed proximal an end of the treatment element 14 optionally protruding into the retention material 16. The large inner cone end preferably has the same shape as the shell, i.e., cylindrical, oval, or other suitable shapes. The inner cone 24 also comprises a small inner cone end 40 having a first diameter. The large inner cone end 34 preferably further comprises a section that curves inward toward a radial direction thus defining a recessed portion 38. In other words, the inner end cone 24 diverges from a first diameter at small inner cone end 40 to a second larger diameter, with a third diameter at recessed portion 38 disposed on a side of the second larger diameter opposite the first diameter. The first diameter is smaller than the third diameter and the third diameter is smaller than the second diameter. Thus, the recessed portion is disposed between the second and third diameters. The transition to the third diameter can be instantaneous (e.g., a ledge), or gradual (e.g., a cone, converging, etc.). The inner wall 36, on the end opposite recessed portion 38, leads to a small inner cone end 40. The small inner cone end 40 is sized to fit within the small outer cone end 32 so that these two ends engage each other, or to engage small outer cone end 32 at engagement point 18. In other words, the outer wall 30 is disposed in a spaced relation to at least a portion of the inner wall 36.

The outer and inner cones 22, 24, which diverge from at or near ends 28,34 toward at or near ends 32,40, can have a circular minor axis cross-section or can have a suitable non-circular configuration such as oval or trapeziodal. The major axis is disposed in a direction from the small outer cone end 32 toward the large outer cone end 34 and the minor axis is perpendicular to the major axis. The choice of material for the inner and outer cones 22, 24 depends upon the type of gas, the maximum temperature reached by the exhaust emission control device 10, the maximum temperature of the gas stream, and the like. Suitable materials include materials capable of resisting under-car salt, temperature, and corrosion. Typically, ferrous materials are employed, e.g. ferritic stainless steels. Ferritic stainless steels include stainless steels such as, e.g., the 400—Series such as SS-409, SS-439, and SS-441.

The outer and inner walls 30, 36 of the end cone assembly are preferably spaced apart along at least a portion of the end cones 22,24 to define an insulating space 42. The space is defined by the inner surface 44 of the outer wall 30 and the outer surface 46 of the inner wall 36. The size of the insulating space 42 may vary along the length of the inner and outer walls 36,30. In a preferred embodiment, the insulating space is free of insulating material; i.e., the insulating space preferably comprises air.

The recessed portion 38 of the inner cone comprises an insulating member 26. Insulating member 26 preferably fills the space between the outer surface of the inner cone wall 46 at the recessed portion 38 and the inner surface of the outer cone wall 44 directly above the recessed portion 38. When insulating member 26 fills the space between the outer surface of the inner cone wall 46 at the recessed portion 38 and the inner surface of the outer cone wall 44, it forms a barrier between the exhaust gas flow through treatment element 14 and the insulating space 42. By barrier, it is meant that the insulating member obstructs access to exhaust gas to the insulating space thus inhibiting the flow of exhaust gas from the treatment element to the insulating space. In addition to inhibiting gas flow, the barrier can also act as a thermal barrier to protect the shell of the exhaust emission control device from excess heat.

The insulating member 26 can comprise a fibrous material such as a non-intumescent material, an intumescent material (e.g., a material that comprises vermiculite component, i.e., a component that expands upon the application of heat), a stainless steel wire rope seal or a combination thereof. These materials can comprise ceramic materials (e.g., ceramic fibers) and other materials such as organic and inorganic binders and the like, or combinations comprising at least one of the foregoing materials. Non-intumescent materials include materials such as those sold under the trademarks "NEXTEL" and "INTERAM 1101HT" by the "3M" Company, Minneapolis, Minn., or those sold under the trademark, "FIBERFRAX" and "CC-MAX" by the Unifrax Co., Niagara Falls, N.Y., and the like. Intumescent materials include materials sold under the trademark "INTERAM" by the "3M" Company, Minneapolis, Minn., as well as those intumescent materials which are also sold under the aforementioned "FIBERFRAX" trademark, as well as combinations thereof and others. Stainless steel wire rope seals include those knitted and/or formed by companies such as Metex Corporation, Edison, N.J., and the like. When an ultra thin wall, high cell density substrate is used (e.g., cell densities greater than or equal to about 600 cells per square inch, preferably greater than or equal to about 800 cells per square inch, and more preferably greater than or equal to about 1,200 cells per square inch, and cell wall thickness of less than or equal to about 4.3 mils (about 0.109 mm), preferably less than or equal to about 2.5 mils (about 0.064 mm)), it is preferred that the insulating member is free of vermiculite, i.e., that the insulating member is a non-intumescent material. By free of vermiculite is meant that the insulating material comprises less than or equal to about 0.5 wt % of vermiculite based on the total weight of the insulating material.

The shell 12, disposed adjacent to or extending from the inner end cone 24, can have a circular cross-section or can have a suitable non-circular configuration such as, for example, oval or trapeziodal. The choice of material for the shell or housing 12 depends upon the type of exhaust gas, the maximum temperature reached by the exhaust emission control device 10, the maximum temperature of the exhaust gas stream, and the like. Suitable materials include materials such as those used to form the end cone.

The treatment element 14, which is disposed within shell 12, comprises a material designed for use in a spark ignition or diesel engine environment and having the following characteristics: (1) capable of operating at temperatures up to about 600° C., and up to about or even greater than about 1,000° C. for some applications, depending upon the device's location within the exhaust system (manifold mounted, close coupled, or underfloor) and the type of system (e.g., gasoline or diesel); (2) capable of withstanding exposure to hydrocarbons, nitrogen oxides, carbon monoxide, particulate matter (e.g., soot and the like), carbon dioxide, and/or sulfur; and (3) having sufficient surface area and structural integrity to support a catalyst, if desired. Some possible materials include cordierite, silicon carbide, metal, metal oxides (e.g., alumina, and the like), glasses, and the like, and mixtures comprising at least one of the foregoing materials. Some ceramic materials include "Honey Ceram", commercially available from NGK-Locke, Inc, Southfield, Mich., and "Celcor", commercially available from Corning, Inc., Corning, N.Y. These materials can be in the form of foils, preforms, mats, fibrous materials, monoliths (e.g., a honeycomb structure, and the like), other porous structures (e.g., porous glasses, sponges), foams, pellets, particles, molecular sieves, and the like (depending upon the particular device), and combinations comprising at least one of the foregoing materials and forms, e.g., metallic foils, open pore alumina sponges, and porous ultra-low expansion glasses. Located between the treatment element 14 and shell 12 can be a retention material 16 that insulates the shell from both the high exhaust gas temperatures and the exothermic catalytic reaction occurring within the catalyst substrate. The retention material 16, which can enhance the structural integrity of the substrate by applying compressive radial forces about it, reducing its axial movement and retaining it in place, can be concentrically disposed around the substrate to form a treatment element 14/retention element 16 subassembly. The retention element 16, which can be in the form of a mat, particulates, or the like, can comprise materials similar to those employed for the insulating member 26.

The present disclosure also includes methods of making an exhaust emission control device 10. In one embodiment, finished end cone assemblies 20 are installed on the exhaust emission control device 10 after disposing the treatment element 14 and the retention element 16 in the shell 12. The treatment element 14 and the retention element 16 can be inserted (for example, stuffed) into the shell as a treatment element 14/retention element 16 subassembly. In this embodiment, the large outer cone end 28 can be sized to slide over the shell 14 such that the large outer cone end 28 can be attached (i.e., welded) to the outer surface of the shell 12 to hold the dual end cone assembly 20 in place and to seal the joints against exhaust gas leakage.

In another embodiment, the outer cone 22 can be formed by spin forming, thus resulting in an outer cone 22 integral to the shell 12. In other words, the shell and the outer cone are a single, unified piece, that is, formed from a single continuous piece with no joints, etc. In this embodiment, prior to spin forming, the shell 12 has a length greater than or equal to about a sum of the lengths of the treatment element 14 and the inner cone 24. The treatment element 14/retention element 16 subassembly and the inner cone(s) 24 are inserted into an open-ended shell. The outer cone(s) 22 are then formed by spin forming the open ends of the shell 12.

In order to spin form the outer cone 22, a spinning machine is used. The spinning machine can include a mandrel or a shaft and a plurality of rollers spaced at different distances from a spin axis, to spin form one end of the shell and form the outer cone 22. The exhaust emission control device with unformed ends (i.e., an open shell) is horizontally mounted on the mandrel such that the exhaust emission control device is capable of rotating around the central axis. The progression of the shell 12 through the forming rollers can achieve multiple reduction steps in the shell to form a shaped outer cone 22. The outer cone 22 can be shaped into the desired shape such as, for example, a cylindrical, oval or trapezoidal shape.

A method of use of the disclosed end cone 20 comprises fluidly connecting an exhaust emission control device 10 comprising the disclosed end cone 20 in an emissions stream and flowing the emissions stream through the exhaust emission control device 10.

One advantage of the dual end cone design disclosed herein is that flexibility in the form of the inner and outer cones can be provided. It is believed that by disposing the insulating member in the recessed portion of the inner cone and not throughout the space between the inner and outer cones, the form of the outer cone can be independent of the form of the inner cone. The outer cone can be formed into the shape of, for example, an oval or a trapezoid, independent of the shape of the inner cone. This design flexibility is particularly advantageous when the outer cone and the shell are a single, unified piece and the outer cone is spin formed. In prior dual end cone designs, spin forming cross sections other than circular cross sections was difficult due to the presence of insulating material a space between the inner and outer cones which could become damaged during spin forming. Because the insulating space between the inner and outer cones is free of insulating material in the current design, different end cone/shell shapes can be formed. In addition, the design disclosed herein can allow for shorter spin forming times than previous designs.

Another advantage of the disclosed dual end cone design is that the insulating member can provide a thermal barrier between the main exhaust gas flow and the insulating space between the inner and outer cones. Such a barrier can help to maintain the temperature of the exhaust emission control device at acceptable levels.

Yet another advantage of the dual end cone design disclosed herein is a reduction in the cost of insulation while retaining most of the benefits of insulation. The insulating material contributes significantly to the cost of materials for formation of an exhaust emission control device. By disposing the insulating material in the recessed portion only rather than throughout the entire space between the outer and inner cones (e.g., using an air space as insulation in the spaced portion between the outer and inner end cones), a significant cost savings can be achieved without sacrificing performance of the device. Thus, the dual end cone disclosed herein results both in design flexibility and cost savings as compared to previous designs.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An end cone assembly for an exhaust emission control device, comprising:

an outer cone comprising a small outer cone end and a large outer cone end with an outer wall extending therebetween, wherein the outer wall diverges from proximal the small outer cone end toward the large outer cone end;

an inner cone comprising a small inner cone end and a large inner cone end with an inner wall having a first diameter proximal the small inner cone end, wherein the inner wall diverges to a second diameter, wherein the second diameter is disposed proximal a recessed portion having a third diameter at the large inner cone end, and wherein the first diameter is smaller than the third diameter and the third diameter is smaller than the second diameter; and an insulating member disposed within the recessed portion of the inner cone;

wherein the outer wall is disposed in a spaced relation to at least a portion of the inner wall and wherein, with the exception of the recessed portion, the space between the inner and outer walls is free of insulating material.

2. The end cone assembly of claim 1, wherein a main axis is disposed in a direction from the small outer cone end toward the large outer cone end and wherein a cross sectional area of the outer cone taken along a minor axis perpendicular to the major axis is non-circular.

3. The end cone assembly of claim 2, wherein the cross sectional area of the outer cone is oval or trapezoidal.

4. The end cone assembly of claim 1, wherein the insulating member comprises no vermiculite.

5. The end cone assembly of claim 1, wherein the small inner cone end is sized to fit within the small outer cone end, and wherein the inner cone is only in physical contact with the outer cone at the small inner cone end.

6. The end cone assembly of claim 1, wherein the inner cone wall and outer cone wall are in a spaced relationship from the large inner cone end to the first diameter of the inner wall.

7. An exhaust emission control device, comprising:

a shell;

a treatment element disposed within the shell;

a retention element disposed between the shell and the treatment element; and an end cone assembly disposed at a first end of the shell the end cone assembly comprising:

an outer cone comprising a small outer cone end and an outer wall extending to and in contact with the shell, wherein the outer wall diverges from proximal the small outer cone end toward the shell, and wherein the outer cone and the shell are a single, continuous piece;

an inner cone comprising a small inner cone end and a large inner cone end with an inner wall having a first diameter proximal the small inner cone end, wherein the inner wall diverges to a second diameter, wherein the second diameter is disposed proximal a recessed portion having a third diameter at the large inner cone end, and wherein the first diameter is smaller than the third diameter and the third diameter is smaller than the second diameter; and an insulating member disposed within the recessed portion of the inner cone;

wherein the outer wall is disposed in a spaced relation to at least a portion of the inner wall and wherein, with the exception of the recessed portion, the space between the inner and outer walls is free of insulating material.

8. The exhaust emission control device of claim 7, wherein a main axis is disposed in a direction from the small outer cone end toward the shell and wherein a cross sectional area of the outer cone taken along a minor axis perpendicular to the major axis is non-circular, and wherein a cross sectional area of the inner cone taken along a minor axis perpendicular to the major axis is circular.

9. The exhaust emission control device of claim 8, wherein the cross sectional area of the outer cone is oval or trapezoidal.

10. The exhaust emission control device of claim 7, wherein the insulating member comprises no vermiculite.

11. The exhaust emission control device of claim 7, wherein the small inner cone end is sized to fit within the small outer cone end, and wherein the inner cone is only in physical contact with the outer cone at the small inner cone end.

12. The exhaust emission control device of claim 7, wherein the inner cone wall and outer cone wall are in a spaced relationship from the large inner cone end to the first diameter of the inner wall.

* * * * *